US006151465A

United States Patent [19]

Toba et al.

[11] Patent Number: 6,151,465

[45] Date of Patent: Nov. 21, 2000

[54] ELECTRICAL CONTACT DEVICE FOR DEVELOPING ROLLER

[75] Inventors: Shinjiro Toba, Numazu; Tadayuki Tsuda, Susono; Shinichi Sasaki, Shizuoka-ken, all of Japan

[73] Assignee: Canon Kabushiki Kaisha, Tokyo, Japan

[21] Appl. No.: 09/370,906

[22] Filed: Aug. 10, 1999

[30] Foreign Application Priority Data

Aug. 13, 1998 [JP] Japan ..... 10-228815

[51] Int. Cl.[7] ..... G03G 15/06

[52] U.S. Cl. ..... 399/90; 399/119

[58] Field of Search ..... 399/90, 37, 75, 399/88, 107, 110, 111, 119, 265, 277; 174/59; 439/188, 526, 924.1

[56] References Cited

U.S. PATENT DOCUMENTS

| | | | |
|---|---|---|---|
| 4,708,455 | 11/1987 | Kubota et al. | 399/111 |
| 4,872,418 | 10/1989 | Yoshikawa et al. | 399/277 |
| 5,272,505 | 12/1993 | Shishido et al. | 399/174 |
| 5,283,619 | 2/1994 | Nomura et al. | 399/90 |
| 5,634,175 | 5/1997 | Michlin et al. | 399/90 |
| 5,655,181 | 8/1997 | Chadani et al. | 399/114 |
| 5,682,587 | 10/1997 | Higeta et al. | 399/277 |
| 5,701,562 | 12/1997 | Araki et al. | 399/265 |
| 5,708,925 | 1/1998 | Kobayashi et al. | 399/120 |
| 5,761,584 | 6/1998 | Tsuda et al. | 399/258 |
| 5,768,658 | 6/1998 | Watanabe et al. | 399/111 |
| 5,802,431 | 9/1998 | Nagashima et al. | 399/262 |
| 5,832,343 | 11/1998 | Kobayashi et al. | 399/119 |

*Primary Examiner*—Sophia S. Chen

*Attorney, Agent, or Firm*—Fitzpatrick, Cella, Harper & Scinto

[57] ABSTRACT

A developing apparatus includes a cylindrical rotatable developer carrying member for carrying a developer to a developing position. A non-rotary insulating magnet roller, provided in the cylindrical developer carrying member. A electroconductive member provided on the magnet roller, the electroconductive member partly constituting a voltage supplying path for supplying a voltage to the developer carrying member. A sliding contact, provided on inside of the developing sleeve, for establishing electric connection between the electroconductive member, and an inside surface of the developer carrying member in the voltage supplying path.

15 Claims, 6 Drawing Sheets

ELECTRICAL CONTACT DEVICE FOR DEVELOPING ROLLER

FIELD OF THE INVENTION AND RELATED ART

The present invention relates to a developing apparatus installable in an image forming apparatus such as an electrophotographic copying machine or an electrophotographic printer.

In an image forming apparatus, a latent image is formed on an electrophotographic photosensitive member, and this latent image is developed into a visible image by a developing apparatus. As an image forming operation, by an image forming apparatus, lasts longer than a certain length of time, it becomes necessary to perform a maintenance operation. For example, it is necessary to replace the electrophotographic photosensitive member to supply the image forming apparatus with developer, or to replace, adjust, or clean the charging device and the cleaning means. In the past, these maintenance operations have been rather difficult for an average user to perform, and have been generally performed by service personnel with professional knowledge.

Thus, a process cartridge in which image forming means, for example, an electrophotographic photosensitive member, a developing apparatus, and the like, are integrally disposed was invented and commercialized. This made it easier for average users to maintain or replace the processing means whenever their maintenance became necessary. As a result, it became possible to produce a high quality image easily and inexpensively.

Referring to FIG. 6, an image forming apparatus, inclusive of a process cartridge such as the one described above, which develops a latent image on an electrophotographic photosensitive member with the use of developer, (hereinafter, toner), comprises development roller 50 as a developer bearing member, which contains a magnetic roller (unillustrated). One of the longitudinal ends of development roller 50 is fitted with gear 51. Development roller 50 is also provided with a charging means for charging toner. It is charged while being rotated. Gear 51 of development roller 50 meshes with gear 53 of photosensitive drum 52, that is, the electrophotographic photosensitive member, so that development roller 50 rotates following the rotation of photosensitive member 52. As for the system for supplying development roller 50 with electricity, elastic member 54, formed of metallic material such as phosphor bronze or SUS, is placed in contact with metallic plate 55, as an electrode, so that it rubs against metallic plate 55. Elastic member 54 and metallic electrode 55 are on the outward side of the gear 51.

However, placement of the contact point, at which the rubbing occurred on the outward side of gear 51, allows the scattered toner or dust to adhere to the contact point. Therefore, there is a fear that electrical power may not be reliably transmitted through the contact point.

Further, the placement of the contact point on the outward side of gear 51 sometimes makes it necessary to increase the image forming apparatus size in terms of the longitudinal direction of the development roller.

In addition, when electrical power is transmitted through the contact point between the two metallic members which rub against each other, it is unavoidable that the surfaces of the metallic members deteriorate as they rub against each other. Further, electrical noise which occurs, due to the rubbing of the two metallic members against each other, increases in proportion to the length of time the two members rub against each other. Therefore, there is a fear that the electrical noise might reduce image quality.

SUMMARY OF THE INVENTION

The primary object of the present invention is to provide a developing apparatus in which voltage is more efficiently supplied to the developer-bearing member, compared to a conventional developing apparatus.

Another object of the present invention is to provide a developing apparatus in which electrical power is more reliably transmitted through the electrical contact point.

Another object of the present invention is to place the sliding contact point inside the developer-bearing member, so that it becomes possible to provide a smaller development apparatus.

Another object of the present invention is to provide a developing apparatus in which the noise generated due to the rubbing which occurs at the electrical contact point does not create a problem.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention, in the form of a development roller, which constitutes an integral part of a process cartridge, will be described with reference to the appended drawings.

Embodiment 1

Figure 1:
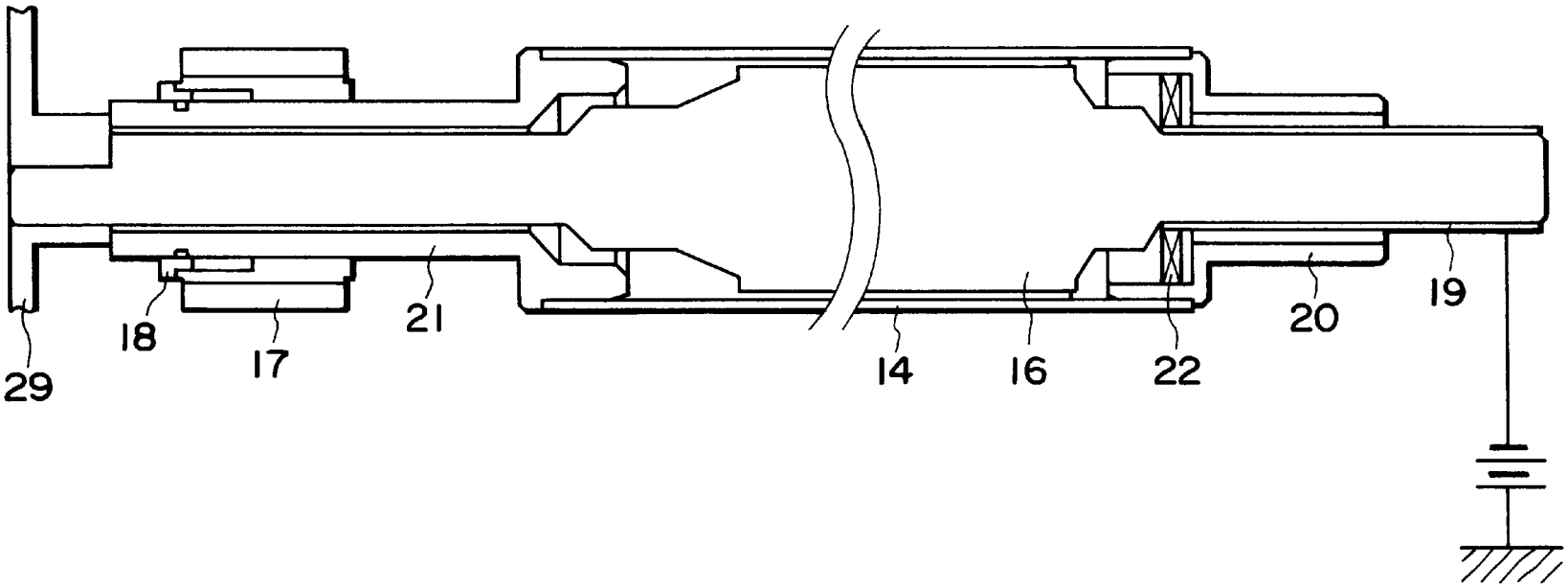
FIG. 1 is a schematic sectional view of a development roller, which depicts the structure through which electrical power is transmitted to the development roller.
Figure 2:
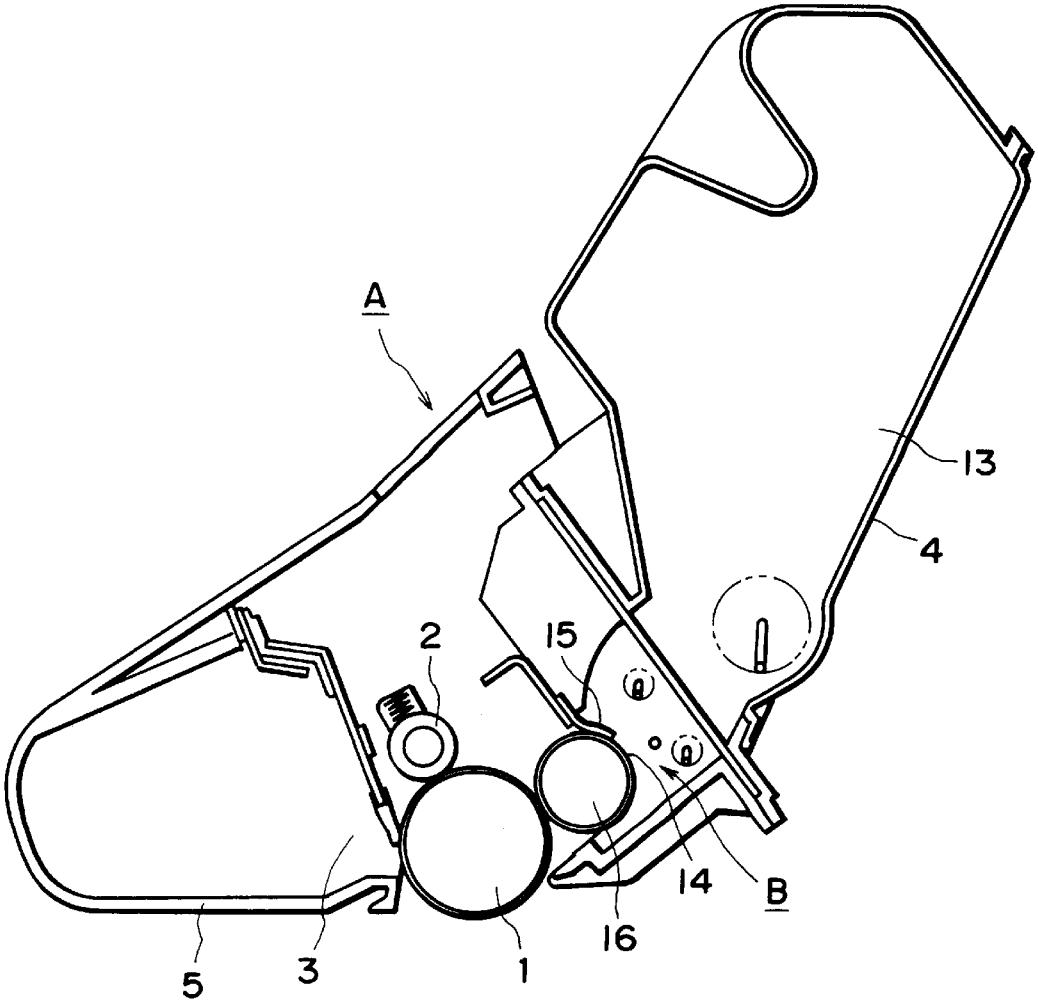
FIG. 2 is a schematic sectional view of a process cartridge, which depicts the general structure of the process cartridge.
Figure 3:
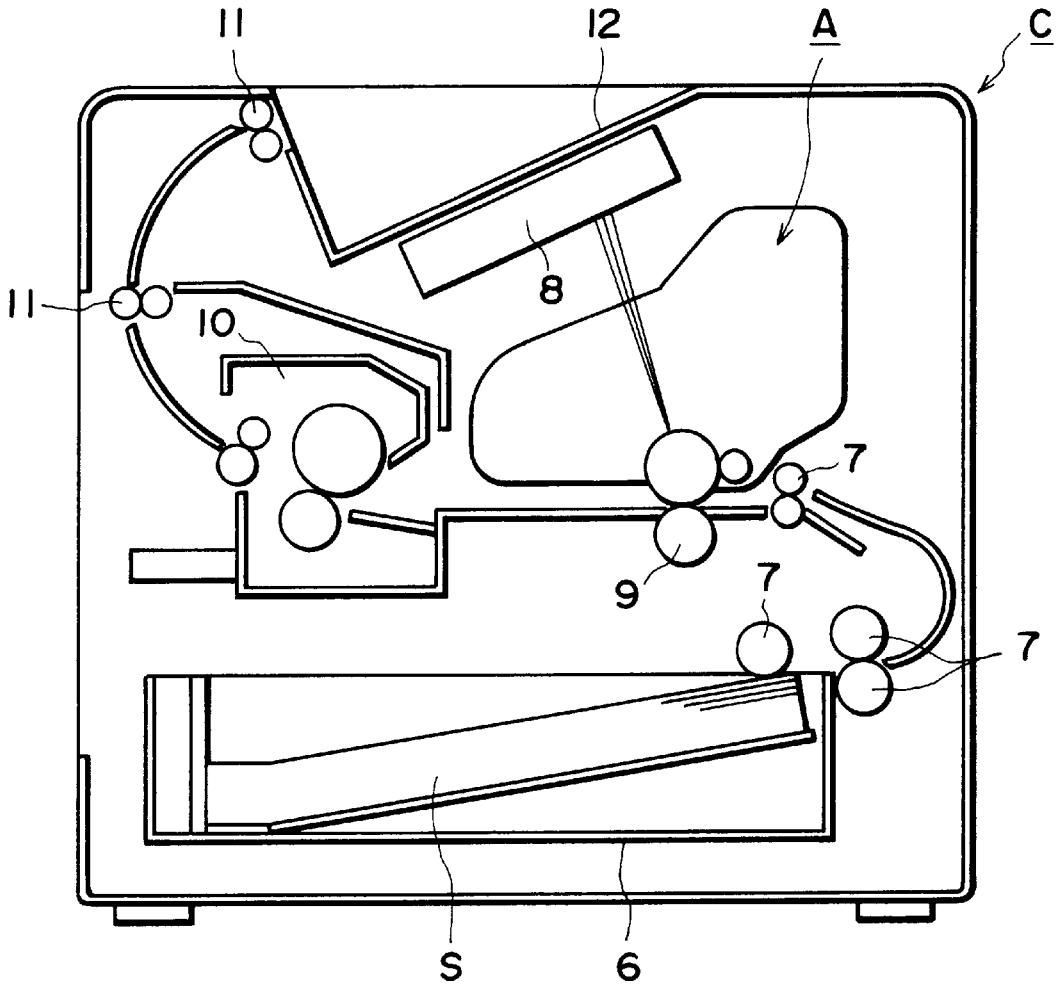
FIG. 3 is a schematic sectional view of an image forming apparatus which contains a process cartridge.

Referring to FIGS. 1 to 3, the first embodiment of the present invention will be described. FIG. 1 is a schematic sectional view of a development roller as a developer-bearing member and its adjacencies, which depicts the structure through which electric power is transmitted to the development roller.

First, the general structure of a process cartridge will be described with reference to FIG. 2. Process cartridge A comprises photosensitive drum 1 as the electrophotographic photosensitive member, and a minimum of the developing apparatus as a processing means, which works on photosensitive drum 1. There are other processing means besides the developing apparatus: for example, a charging apparatus for uniformly charging the peripheral surface of photosensitive drum 1, and a cleaning apparatus for removing the toner, which remains on the peripheral surface of photosensitive drum 1.

Process cartridge A, in this embodiment, consists of a housing, photosensitive drum 1, charging apparatus 2, developing apparatus B, and cleaning apparatus 3. The housing consists of frames 4 and 5 joined with each other. Charging apparatus 2, developing apparatus B, and cleaning apparatus 3 are disposed around photosensitive drum 1. Process cartridge A is installed in the image forming apparatus C, illustrated in FIG. 3, to be used for image formation. In an image forming operation, sheet S is fed out by conveyer roller 7 from sheet cassette 6, which has been installed into the bottom portion of the image forming apparatus. In synchronism with the conveyance of the sheet, a latent image is formed on the peripheral surface of photosensitive drum 1, by selectively exposing the peripheral surface of photosensitive drum 1, to the beam of light projected from exposing apparatus 8. Then, the latent image is developed into a visible image, (toner image), by developing apparatus B, which uses toner. The toner image is transferred by applying bias, (electrical voltage), to transfer roller 9 onto sheet S, which is being conveyed forward. Next, sheet S is conveyed to fixing apparatus 10, in which the toner image is fixed to the sheet. Thereafter, the sheet is discharged by discharge roller 11 into delivery station 12, located at the top of the image forming apparatus.

Next, developing apparatus B in process cartridge A will be described. Referring to FIG. 2, this developing apparatus comprises toner chamber 13, development roller 14, and development blade 15 as a toner layer regulating member. In an operation for developing a latent image, the toner in toner chamber 13 is borne on the peripheral surface of development roller 14, which is being rotated. As the toner is borne on development roller 14, it is regulated by development roller 14. Next, as development bias, that is, electrical voltage, is applied to development roller 14, the toner is adhered to the peripheral surface of photosensitive drum 1 according to the latent image on photosensitive drum 1. Development roller 14 consists of electrically conductive, cylindrical, metallic sleeve formed of aluminum, stainless steel, or the like, and electrically nonconductive, nonrotational, magnetic roller 16. The magnetic roller is contained in the sleeve and fixed to the frame of the image forming apparatus.

Referring to FIG. 1, development roller 14 is provided with roller gear 17, which is attached to one of the longitudinal ends of the development roller with the use of engagement claw 18. Roller gear 17 is formed of resin such as POM, polycarbonate, or nylon, (POM and polycarbonate may contain lubricant), and rotates with development roller 14. Roller gear 17 is a helical gear, and meshes with another helical gear, (unillustrated), attached to one of the longitudinal ends of photosensitive drum 1, so that rotational force is transmitted to development roller 14 as photosensitive drum 1 rotates. In order to apply the bias, or electrical voltage, to development roller 14, magnetic roller 16 is provided with electrically conductive, cylindrical member 19, which is attached to the small diameter portion, (axial portion), of the magnetic roller, so that electrical power can be supplied to development roller 14 by connecting the electrically conductive member 19 to the electrical power source on the main assembly side of the image forming apparatus.

Also referring to FIG. 1, electrically conductive member 19 is connected to development roller 14 with the use of a connecting means, so that electrical power is supplied to development roller 14. More specifically, one, (first), of the longitudinal ends of development roller 14 is provided with flange 20, and the other, (second), is provided with flange 21. Also, the first longitudinal end of development roller is provided with electrically conductive bearing 22, which is placed in contact with the internal surface of flange 20. Bearing 22 is disposed, so that the internal surface of the bearing contacts electrically conductive member 19, which is fitted around magnetic roller 16. With the provision of this bearing, development roller 14 is allowed to smoothly rotate about magnetic roller 16, which is held by developing apparatus holder 29. Flange 20 is supported by the wall of the developer chamber.

Bearing 22 is a metallic rolling bearing, or a sliding bearing formed of electrically conductive resin, (mixture of PPS and carbon filler (30%), mixture of POM and carbon filler (20%), or the like). In the case of a sliding bearing, the interface between the outward surface of bearing 22 and the inward surface of the cylindrical portion of the developer-bearing member functions as the sliding contact.

Electrically conductive member 19 is a cylindrical member formed of phosphor bronze or similar material, and is press-fitted around the small diameter portion of magnetic roller 16. The conductive member may be provided with a longitudinal slit. Instead of using electrically conductive member 19, the small diameter portion of magnetic roller 16 may be plated with electrically conductive material. After the fitting, electrically conductive member 19 extends within the small diameter portion of the developer-bearing member from the longitudinal end of the large diameter portion of the developer-bearing member to the longitudinal end of the small diameter portion of magnetic roller 16.

In the above described structure, electrical power is supplied to development roller 14 through electrically conductive member 19 of magnetic roller 16, electrically conductive bearing 22, and flange 20 in this order. With this arrangement, the connecting means for supplying electrical power to development roller 14 is within the development roller, the connecting means is not exposed. Therefore, dust or the like does not adhere to this portion. Further, since electrical connection is made by bearing 22, the frictional noise does not occur, and the gap between magnetic roller 16 and development roller 14 can be precisely maintained. In other words, in comparison to a conventional connecting means in which the metallic members slide against each other, outside the development roller, the connecting means in this embodiment generates far less noise while supplying the development roller with electrical power.

Embodiment 2

Figure 4:
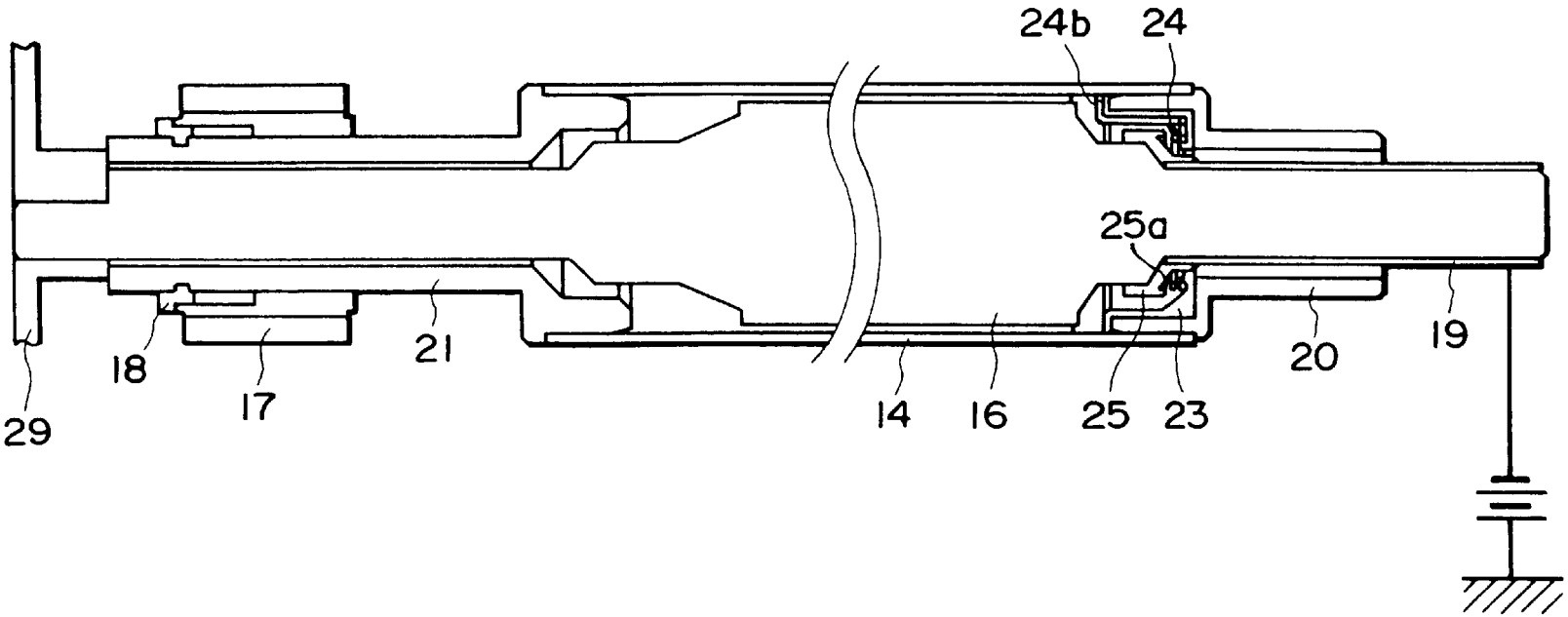
FIG. 4 is a schematic sectional view of a development roller in the second embodiment of the present invention, which depicts the structure through which electrical power is transmitted to the development roller.
Figure 5:
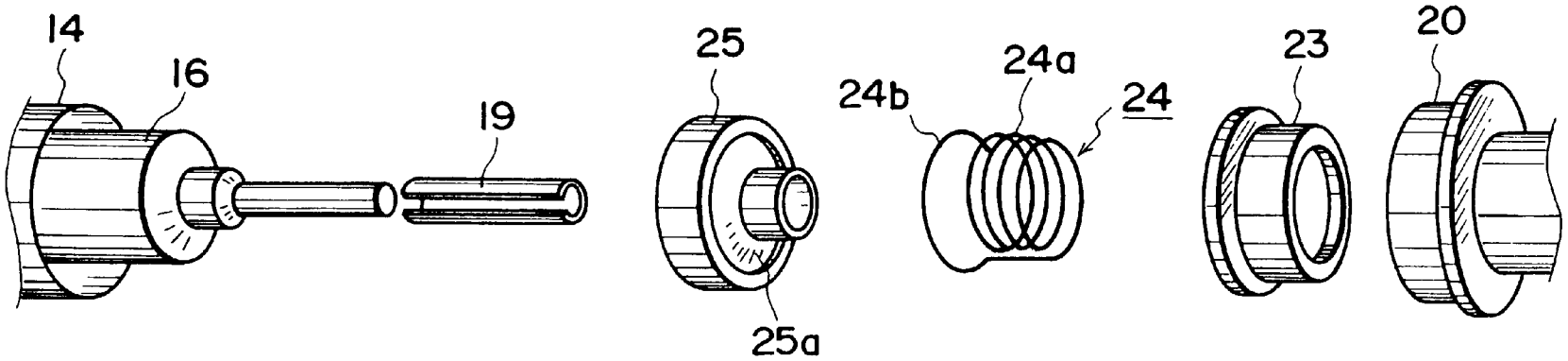
FIG. 5 is a perspective view of the disassembled structure for transmitting electrical power to a development roller.
Figure 6:
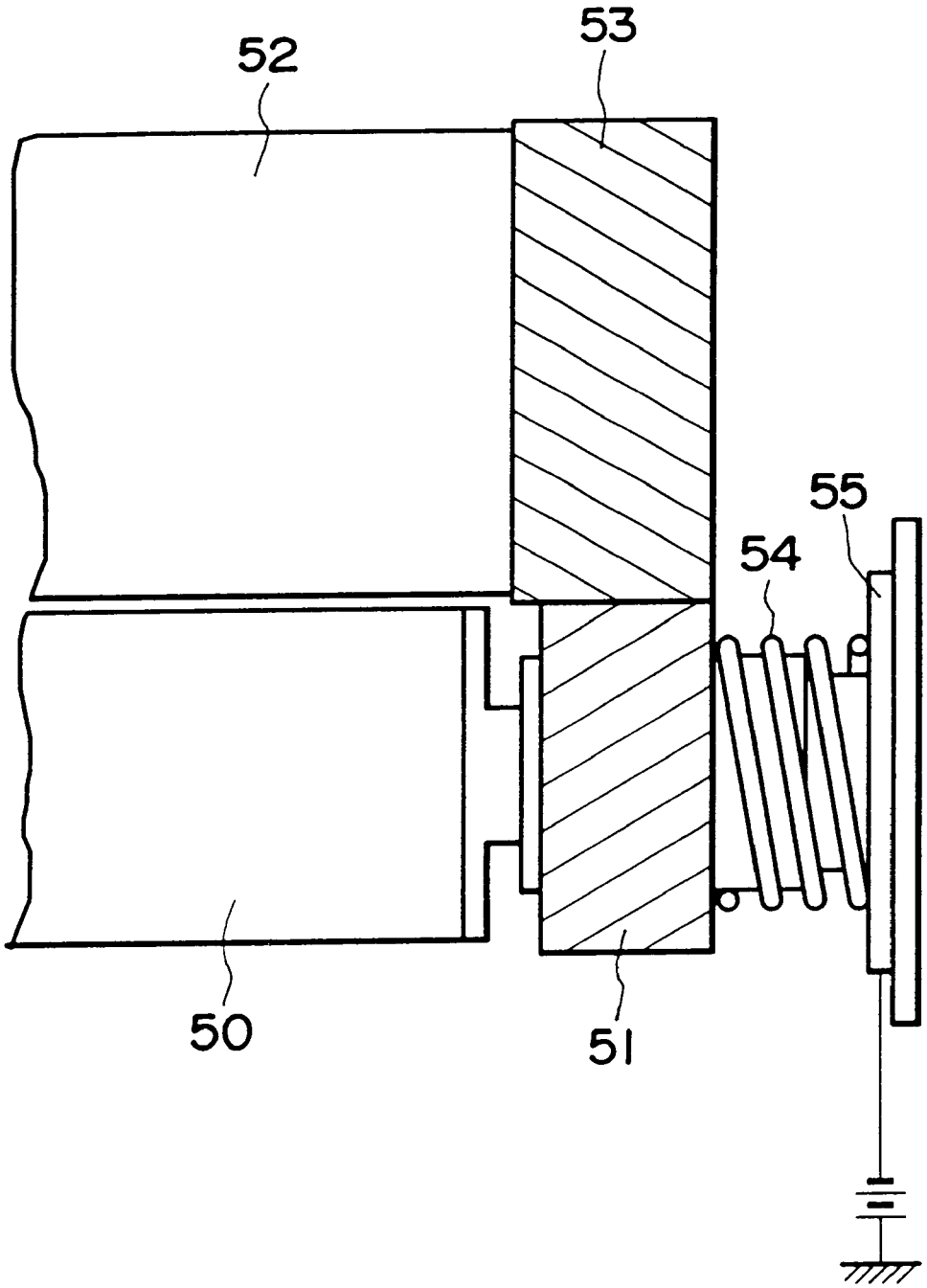
FIG. 6 PRIOR ART
FIG. 6 is a schematic sectional view of the conventional structure through which electric power is transmitted to the development roller.

Next, the developing apparatus in the second embodiment of the present invention will be described with reference to FIGS. 4 and 5. FIG. 4 is a schematic sectional view of the developing apparatus in the second embodiment of the present invention and depicts the structure of the electrical contact portion of the development roller. FIG. 5 is a perspective view of the disassembled electrical contact portion of the development roller. When a member in FIG. 4 has a counterpart in FIG. 1, both are given the same referential character, so that repetition of the same description can be avoided.

In the second embodiment, the electrical contact through which electrical power is supplied to development roller 14 of the developing apparatus consists of two members composed of electrical conductive resin. These two members replace the bearing in the first embodiment.

Referring to FIG. 4, cylindrical member 23, formed of resin is press-fitted in flange 20. In the internal space of the cylindrical member, coil spring 24, that is, an electrically conductive elastic member, is disposed. More specifically, referring to FIG. 5, coil spring 24 has arm portion 24*b*, which extends from the end of coiled portion 24*a* of coil spring 24. As coil spring 24 is fitted into the internal space of cylindrical member 23, arm portion 24*b* comes in contact with the internal peripheral surface of development roller 14, (FIG. 4).

The small diameter portion of magnetic roller 16 is fitted with electrically conductive member 25, so that electrically conductive member 25 contacts electrically conductive member 19 and the coiled portion of coil spring 24. Electrically conductive member 25 is formed of resin. In order to assure that electrically conductive member 25 contacts the coil spring, electrically conductive member 25 is provided with tapered portion 25*a*, so that the force, which is generated as tapered portion 25*a* of electrically conductive member 25 presses coiled portion 24*a*, keeps the axis of coil spring 24 and the axis of electrically conductive member 25 aligned to prevent coil spring 24 and electrically conductive member 25 from becoming disengaged from each other. With the presence of this aligning force, which is generated as coiled portion 24*a* of coil spring 24 is compressed, or allowed to decompress, by tapered portion 25*a* of electrically conductive member 25, once coil spring 24 is placed in contact with tapered portion 25*a* of electrically conductive member 25 during the assembly of the developing apparatus, coil spring 24 and electrically conductive member 25 never becomes disengaged from each other, no matter what kind of movement magnetic roller 16 makes in development roller 14. Therefore, the electrical connection between development roller 14 and the power source is O prevented from becoming poor or interrupted. Also, abnormal noise does not occur.

Further, cylindrical member 23 fitted in development roller 14 immovably holds coil spring 24. Therefore, as development roller 14 rotates, coil spring 24 slides on electrically conductive member 25. Thus, in order to reduce the friction between coil spring 24 and electrically conductive member 25, it is desired that the winding direction of coiled portion 24*a*, which slides on electrically conductive member 25 is made to coincide with the rotational direction of development roller 14.

In this embodiment, electrical power is supplied to development roller 14 through electrically conductive member 19, which is fitted around magnetic roller 16, electrically conductive member 25, and coil spring 24 in this order. Also, the portion on which coil spring 24 slides is formed of electrically conductive material. Therefore, the noise generated at the contact point in this embodiment is far smaller than the noise generated at a conventional contact point at which metallic members rub against each other.

Miscellaneous Embodiments

In the preceding embodiments, process cartridge A comprises photosensitive drum 1, charging apparatus 2, developing apparatus B, cleaning apparatus 3, and the latter three are disposed around photosensitive drum 1. However, process cartridge A may comprise only developing apparatus B, which is structured as described above.

The above described effects are displayed not only by developing apparatus B in process cartridge B, but also by an image forming apparatus equipped with a developing apparatus, which is structured as described above.

In the preceding embodiments, the sliding contact is unexposed because of the above described structure. Therefore, not only the contact portion is protected, but also, the dust which results from the sliding is prevented from scattering, and the noise generated by the sliding is far smaller.

According to another aspect of the present invention, electrical power is supplied to the development roller through the electrically conductive bearing. Therefore, the gap between the magnetic roller and the toner bearing member is precisely maintained. It should be noted here that the employment of the rolling bearing, as one of the electrical contact members, further reduces the amount of the noise generated by the electrical contact portion, compared to the sliding bearing.

According to another aspect of the present invention, electrical power is supplied to the internal peripheral surface of the toner bearing member through the magnetic roller, the electrically conductive member formed of resin, and the electrically conductive elastic member in this order. Therefore, the electrical contact portion in accordance with the present invention produces a far smaller amount of noise compared to the conventional electrical contact portion, at which metallic members rub against each other.

While the invention has been described with reference to the structures disclosed herein, it is not confined to the details set forth, and this application is intended to cover such modifications or changes that may come within the purposes of the improvements or the scope of the following claims.

What is claimed is:

1. A developing apparatus comprising:

a cylindrical rotatable developer carrying member for carrying a developer to a developing position;

a non-rotary insulating magnet roller, provided in said cylindrical developer carrying member;

an electroconductive member provided on said magnet roller, said electroconductive member partly constituting a voltage supplying path for supplying a voltage to said developer carrying member;

a sliding contact, provided inside said developer carrying member so as to be covered by said developer carrying member, for establishing electric connection between said electroconductive member and an inside surface of said developer carrying member in the voltage supplying path.

2. An apparatus according to claim 1, wherein said electroconductive member is cylindrical.

3. An apparatus according to claim 2, wherein said electroconductive member is provided at a shaft of said magnet roller.

4. An apparatus according to claim 1, wherein said developer carrying member includes a first cylindrical portion and a second cylindrical portion having a smaller diameter than said first cylindrical portion and provided at a longitudinal end of said developer carrying member, and wherein said sliding contact is provided in said first cylindrical portion.

5. An apparatus according to claim 1, wherein said developer carrying member is provided with a flange at a longitudinal end thereof, and said inside surface is an inside of said flange.

6. An apparatus according to claim 1, further comprising an electroconductive bearing, between said electroconductive member and said inside of said developer carrying member in said voltage supplying path, for supporting a shaft of said magnet roller.

7. An apparatus according to claim 1, further comprising an electroconductive elastic member between said electroconductive member and said inside of said developer carrying member in said voltage supplying path.

8. An apparatus according to claim 1 or 7, further comprising an electroconductive resin member between said electroconductive member and said inside of said developer carrying member in said voltage supplying path.

9. An apparatus according to claim 1, wherein said magnet roller is of plastic material.

10. An apparatus according to claim 1, wherein said apparatus constitutes a process cartridge with an image bearing member to be developed by said apparatus, said process cartridge being detachably mountable to an image forming apparatus.

11. An apparatus according to claim 10, wherein said image bearing member is an electophotographic image bearing member.

12. A developing apparatus comprising:

a cylindrical rotatable developer carrying member for carrying a developer to a developing position;

a non-rotary insulating magnet roller, provided in said cylindrical developer carrying member;

an electroconductive member provided on said magnet roller, said electroconductive member partly constituting a voltage supplying path for supplying a voltage to said developer carrying member;

a sliding contact, provided on inside of said developer carrying member, for establishing electric connection between said electroconductive member and an inside surface of said developer carrying member in the voltage supplying path, wherein said developer carrying member includes a first cylindrical portion and a second cylindrical portion having a smaller diameter than said first cylindrical portion and provided at a longitudinal end of said developer carrying member, and wherein said sliding contact is provided in said first cylindrical portion, and wherein said electroconductive member is extended from an inside of said first cylindrical portion to an inside of said second cylindrical portion.

13. An apparatus according to claim 12, wherein said electroconductive member is extended from an inside of said first cylindrical portion to a longitudinal end of said magnet roller.

14. An apparatus according to claim 13, wherein the longitudinal end of said magnet roller is outside of the longitudinal end of said developer carrying member.

15. An apparatus according to any one of claims 1, 8, 9, and 10, wherein said developer carrying member is provided with a flange at a longitudinal end thereof, and said flange is extended to a longitudinal end of said first cylindrical portion and to said second cylindrical portion.

* * * * *

UNITED STATES PATENT AND TRADEMARK OFFICE

CERTIFICATE OF CORRECTION

PATENT NO. : 6,151,465
DATED : November 21, 2000
INVENTOR(S) : Shinjiro Toba, et al.

It is certified that error appears in the above-identified patent and that said Letters Patent is hereby corrected as shown below:

Item [57]:
Abstract Line 4, "A" should read -- An --.

Column 4,
Line 33, "above described" should read -- above described --.

Column 5,
Line 27, "becomes" should read -- become --;
Line 30, "is O" should read -- is --;
Line 58, "above described" should read -- above-described --; and
Line 63, "above described" should read -- above-described --.

Column 6,
Line 34, "member;" should read -- member; and --.

Column 7,
Line 11, "electophotographic" should read -- electrophotographic --; and
Line 21, "member," should read -- member; and --.

Column 8,
Line 7, ", and wherein" should read -- , and ¶wherein --;
Line 18, "any one of claims 1,8,9," should read -- claims 12, 13, and 14 --; and
Line 19, "and 10," should be deleted.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*